United States Patent [19]

Lortie et al.

[11] Patent Number: 4,730,772

[45] Date of Patent: Mar. 15, 1988

[54] MOISTURE ELIMINATOR FOR AIR WASHER

[75] Inventors: Richard P. Lortie, Winston-Salem, N.C.; Philippe H. Vercaemert, Littleton, Mass.; Douglas L. Gunnell, Winston-Salem, N.C.

[73] Assignee: R. J. Reynolds Tobacco Co., Winston-Salem, N.C.

[21] Appl. No.: 892,623

[22] Filed: Aug. 4, 1986

Related U.S. Application Data

[62] Division of Ser. No. 599,245, Apr. 11, 1984, Pat. No. 4,627,568.

[51] Int. Cl.[4] ..... B01F 3/02

[52] U.S. Cl. ..... 236/44 R; 165/19; 62/91; 55/344

[58] Field of Search ..... 165/16, 19; 236/44 C, 236/44 A, 44 B; 55/213, 344; 62/91, 176.4, 179

[56] References Cited

U.S. PATENT DOCUMENTS 1,890,070 12/1932 Whiton, Jr. ..... 55/344 X 4,552,303 11/1985 Fisher et al. ..... 165/19 X

*Primary Examiner*—William E. Wayner

*Attorney, Agent, or Firm*—Herbert J. Bluhm

[57] ABSTRACT

An air conditioning system is disclosed which employs an air washer for treating variable volumes of air moving through the air washer per unit of time. The air washer includes a moisture eliminator that is provided with means for changing its effective face area in response to changes in the volume of air moving through the air washer per unit of time.

26 Claims, 3 Drawing Figures

MOISTURE ELIMINATOR FOR AIR WASHER

This is a divisional of co-pending application Ser. No. 599,245 filed on Apr. 11, 1984, now U.S. Pat. No. 4,627,568.

TECHNICAL FIELD

This invention relates to a moisture eliminator for use with an air washer employed in an air conditioning system.

BACKGROUND ART

Air washers have been used extensively in treating moving air streams routed through industrial air conditioning systems which are designed to maintain relatively high moisture levels in the conditioned space. The water spray introduced by these air washers results in water droplets being entrained by the moving air streams. In order to remove these water droplets, moisture eliminators are generally used in conjunction with air washers to ensure that substantially all of the water carried by the air is in the vapor state.

Moisture eliminators are typically constructed of a series of cooperating partitions which are positioned in a spaced, parallel relationship. The partitions are usually provided with an undulated configuration to impart a zigzag movement to the air stream passing between the spaced partitions. Moisture eliminators of this type are shown, for example, in U.S. Pat. Nos. 3,338,035 and 3,912,471. The effectiveness of an eliminator in removing water droplets from an air stream is largely determined by the design of the eliminator and the velocity of the air stream passing through it. Thus, an eliminator can be specifically designed for a high velocity air stream and it will function satisfactorily as long as the air velocity is maintained within a certain range. When the air velocity falls appreciably below this range, there is a corresponding reduction in the eliminator's effectiveness in removing water droplets from the air stream. Such a situation arises, for example, in systems that employ a bypass arrangement for routing a portion of the return air from the conditioned zone around the air washer. As the proportion of air bypassing the air washer increases, the velocity of the air moving through the air washer and the eliminator decreases and eventually reaches a velocity that is unsuitable for removal of entrained water droplets by the eliminator.

In recent years energy considerations have led to the development of variable air volume (hereinafter VAV) systems for processing and distributing conditioned air. In a manner analogous to that discussed above for bypass arrangements, air washers and moisture eliminators used in VAV systems also lead to water droplet carryover as the volume of air being moved through the eliminator and the resultant air velocity associated therewith fall below levels at which the eliminator operates effectively. Accordingly, VAV systems employing an air washer and eliminator arrangement have been limited to operation within a relatively narrow range of air volumes.

BRIEF SUMMARY OF INVENTION

The present invention is directed to an improved air washer arrangement and method which provide greater operating flexibility when such an arrangement and method are used in an air conditioning system. Basically, this improved air washer arrangement and method involve modifications to the moisture eliminator which permit the effective face area of the eliminator to be changed in response to changes in air volume being moved through the system. By changing the effective face area of the eliminator, the velocity of the moist air passing through the eliminator will undergo a corresponding change so that the air velocities can be maintained within the optimum range of velocities recommended for the particular eliminator being used. Thus, it is a principal object of this invention to extend the range of air volumes that may be moved through air conditioning systems employing air washer arrangements. It is a further object of this invention to provide an air washer arrangement which minimizes the problem of water droplet carryover. Other objects and advantages will be apparent from the description which follows.

DETAILED DESCRIPTION OF THE INVENTION

Figure 1:
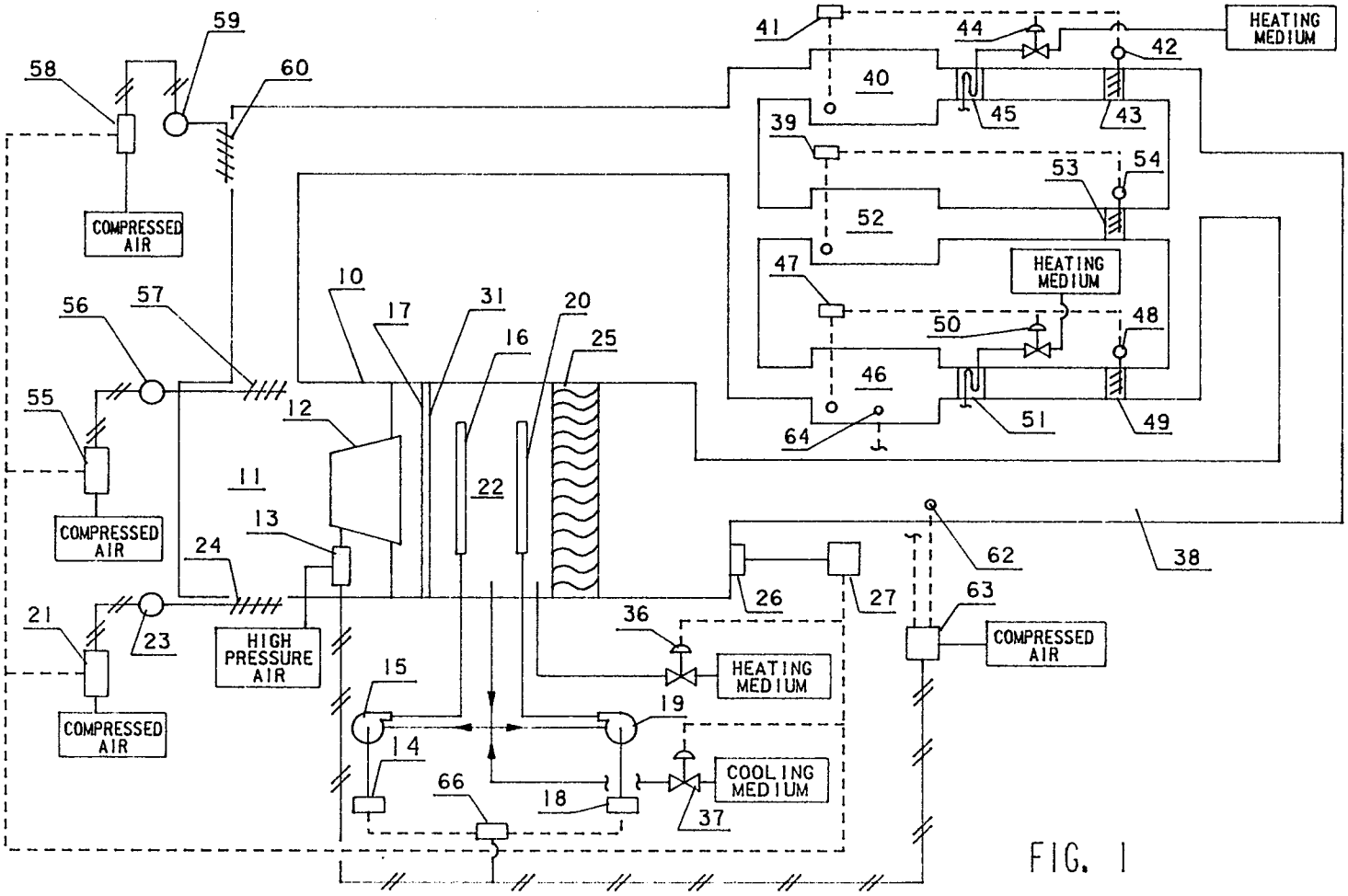
FIG. 1 is a schematic diagram of a VAV air conditioning system which incorporates therein the present invention.

The invention disclosed herein involves an air washer arrangement used in an air conditioning system. Air washers are commonly used to control temperature and humidity levels in air that is supplied to a work space or comfort zone. Air washers usually include moisture eliminators located immediately downstream of water spray devices which inject sprays of water into the air being treated. The eliminators serve to remove droplets of water entrained in the air. When an air washer is employed in a system that is capable of varying flow rates of air through the air washer, the velocity of the air moving through the air washer must be maintained within a relatively narrow range in order to obtain satisfactory operation of the moisture eliminator. This limitation severely curtails operating flexibility and the energy savings potential of such systems.

This invention is based on the discovery that the useful operating range of an air conditioning system incorporating an air washer therein can be extended considerably by modifications involving the moisture eliminator. To achieve this goal the moisture eliminator is provided with means for changing the effective face area of the eliminator in response to changes in the volume of air being moved through the air washer per unit of time. For a given volume of air being moved through the moisture eliminator per unit of time, the velocity of the moving air stream can be increased by reducing the effective face area of the eliminator or reduced by increasing the effective face area of the eliminator. Accordingly, the velocity of the air stream can be controlled within the range prescribed for the particular eliminator design employed by changing the effective face area of the eliminator.

The means for changing the effective face area of the moisture eliminator may take a variety of forms. A sliding panel, for example, may be moved into a position adjacent to the side of the eliminator from which the air exits thereby preventing air flow through that portion of the eliminator obstructed by the panel. It is preferred, however, that a damper assembly be used as the air-obstructing device. In either case a suitable actuator responsive to a signal or switch is employed to move the panel or damper assembly into the obstructing or non-obstructing position. The movement of the air-obstructing device is preferably not modulated in order to avoid excessive localized air velocities when the device is in a partially closed position. Rather, the actuator moves the air-obstructing means to a fully open or fully closed position as dictated by operating conditions in the system. The air-obstructing device may also be located adjacent to the side of the eliminator through which air enters the eliminator but such an arrangement is less desirable because it constantly exposes the device and the actuator to the water droplets entrained in the air stream at that point.

The proportion of the moisture eliminator face area that is effectively obstructed by the panel or damper assembly will depend on several factors including the anticipated maximum and minimum loads placed on the air conditioning system and the design of the moisture eliminator. As a general rule, a sufficient proportion of the eliminator face area must be obstructed at minimum air flow through the air washer so that the resultant velocity of air passing through the eliminator will remain above the recommended minimum velocity for the eliminator. It is also desirable to change the effective face area of the eliminator incrementally to avoid sudden and wide variations in air velocity through the eliminator. Thus, a system provided with air-obstructing means capable of obstructing 40 percent of the effective face area of the eliminator should be designed so that only a portion of the obstructing means is activated at a given air flow rate through the air washer. This can be done by employing two or more actuators each of which controls a portion of the total air-obstructing means. For example, two actuators controlling 20 percent each or four actuators controlling 10 percent each of the air-obstructing means can be activated at different levels of air volume moving through the system so that the maximum 40 percent reduction in effective face area is achieved in two or more steps. The air-obstructing means and actuators associated therewith are also preferably designed so that the obstructing means activated at any given air volume level will maintain the basic symmetry of the air flow path through the eliminator and the enclosure in which it is situated.

A moisture eliminator modified in accordance with the foregoing description forms the basis for a versatile air washer that may be used for treating an air stream directed through the washer. Such a washer comprises a water spray section for injecting controlled amounts of water into the moving air stream, a moisture eliminator adjacent to and downstream of the water spray section for removing water droplets entrained in the moving air stream, means for controlling the volume of air moving through the air washer per unit of time and means for changing the effective face area of the moisture eliminator in response to changes in the volume of air moving through the air washer per unit of time. By effective face area is meant the cross-sectional area of the moisture eliminator that is transverse to the direction of air flow and that is capable of accommodating air flow through that area, the air flow being essentially unobstructed through this area except for the spaced, cooperating partitions.

An air washer provided with the modified moisture eliminator is intended for use in an air conditioning system that involves substantially varying air flow rates through the air washer. Such systems typically include damper means for admitting controlled quantities of outside air (i.e., fresh air) and return air (i.e., "spent" air withdrawn from the conditioned zone) into the air washer. Also included are means for moving variable volumes of air per unit of time through the air washer. As the volume of air moved per unit of time through the washer is reduced to a certain predetermined level, the means for reducing the effective face area of the moisture eliminator is activated. Conversely, an increase in air flow rate through the air washer would lead to an increase in the effective face area of the eliminator.

A type of air conditioning system in which the present invention may be utilized is one that employs an air washer provided with an air bypass arrangement. In such a system a portion of the air that is returned from the conditioned zone to the air washer is routed around the air washer and is combined with treated air emerging from the air washer before being returned to the conditioned zone. Maximum energy savings are realized by routing the maximum amount of return air possible around the air washer. Routing of a portion of the return air through bypass conduit means is conveniently accomplished by damper means modulated by a suitable control device that is responsive to temperature sensing means located in the conditioned zone.

The present invention is particularly suited to use in a VAV air conditioning system. The air flow rate through the air washer is controlled by a variable capacity fan that is responsive to signals from a suitable control device. One preferred arrangement employs a static pressure sensing device positioned in the supply air duct carrying conditioned air to the conditioned zone. This pressure sensing device transmits a signal to a control device which, in turn, transmits an appropriate signal to both the actuator for adjusting fan capacity and the actuator for moving air-obstructing means associated with the moisture eliminator to an open or closed position. The fan capacity is preferably modulated in response to the transmitted signal whereas the air-obstructing means are activated and deactivated at predetermined set points.

In those systems where the fan is located upstream of the moisture eliminator, it is important that the air-obstructing means not be placed in a position of direct confrontation to the fan blades. Since the fan is normally positioned so that the air moved by the fan is directed toward the central portion of the moisture eliminator, this means that the air-obstructing means should not be located in the area of the central portion of the eliminator.

A typical VAV air conditioning system based on the present invention comprises (a) a chamber having an entrance end provided with separate modulated damper means for admitting outside air and return air into the chamber and an exit end for delivering conditioned air to a supply air duct which supplies conditioned air to a conditioned zone or work space, (b) spray means positioned within the chamber intermediate the entrance and exit ends for spraying sufficient quantities of water into air moving through said chamber to deliver conditioned air to the supply air duct that is substantially saturated with water vapor and is adjusted to a predetermined temperature, (c) a moisture eliminator positioned within the chamber intermediate the spray means and the exit end of the chamber for removing droplets of water entrained in the conditioned air with the moisture eliminator having a maximum effective face area through which the conditioned air passes, (d) a variable capacity fan for moving controlled volumes of air through the system per unit of time, (e) sensing means for monitoring the dew point of the conditioned air delivered to the supply air duct and control means associated therewith for modulating the damper means which admit outside air and return air into the chamber, (f) modulated supply air damper means located at the terminus of the supply air duct for admitting conditioned air into the conditioned zone or work space, (g) heating means disposed in the supply air duct adjacent to the supply air damper means for heating the conditioned air as needed, (h) a temperature sensor located in the conditioned zone or work space and control means associated therewith for regulating the heating means and modulating the supply air damper means in response to temperature changes in the conditioned zone or work space, (i) means for changing the effective face area of the moisture eliminator in response to changes in the volume of air moving through the moisture eliminator per unit of time and (j) pressure sensing means located in the supply air duct and control means associated therewith for modulating the capacity of the variable capacity fan, for regulating the quantity of water injected into the air by the spray means as the air moves through the chamber and for changing the effective face area of the moisture eliminator.

The water spray means used in connection with this invention preferably includes sump means for collecting excess spray water and the quantity of water maintained in the sump is held at the desired temperature by suitable control means. For example, a temperature sensor immersed in the quantity of water may be used to transmit a signal to a control device which regulates the flow of heating and cooling media for adjusting the temperature of the water. Alternatively, the sump water temperature may be controlled in response to the dew point of conditioned air delivered to the supply air duct by employing commercially available devices which are capable of monitoring the absolute humidity of air.

It is apparent that the air conditioning systems disclosed herein are suited to maintaining desired temperature and humidity levels in a single work space or comfort zone as well as in several work spaces or comfort zones. Where a plurality of work spaces or conditioned zones are involved, they need not be physically connected but may, for example, be located on separate floors of a multi-story building or in separate rooms on the same floor. A typical installation will involve a supply air duct provided with a number of branches which lead to the work spaces or conditioned zones that are to be served by the system. Each work space or conditioned zone is served by at least one terminus through which the conditioned air is directed into the space. Each terminus has a supply air damper means associated therewith which is responsive to a temperature controller that records signals from temperature sensing means located in the work space served by that terminus. If a given work space requires heated air, the terminus serving that work space is provided with heating means (e.g., a reheat coil through which steam, hot water, etc. may be passed) which is preferably also responsive to the temperature controller and associated temperature sensor which modulates the supply air damper means. The heating means is preferably located immediately downstream of the supply air damper means. If desired, a single temperature controller and associated temperature sensor may regulate the flow of conditioned air through two or more terminuses serving a given work space or conditioned zone. The temperature controllers useful for maintaining desired conditions in the work spaces or conditioned zones include proportional type controllers as well as proportional controllers having integral or integral with derivative control capabilities. Programmable controllers are also suitable and they provide additional flexibility by regulating other control loops in the air conditioning system.

It is also apparent that the air conditioning systems described herein may require appropriate ducts for returning "spent" air from the conditioned zone or work space to the air washer for reconditioning the "spent" air. The techniques for conveying return air from the conditioned zone to the air washer are well known in the art and require no amplification here.

Reference will now be made to the accompanying drawings in order to provide a more complete understanding of the present invention.

Shown in FIG. 1 is a schematic diagram of a preferred arrangement for a variable air volume system which incorporates a moisture eliminator modified in accordance with this invention. An air washer installed within enclosure 10 includes a variable capacity fan 12 for moving air through the system, water spray nozzle assemblies 16 and 20 with associated spray pumps 15 and 19, sump 22 for supplying spray pumps 15 and 19 with water that has been adjusted to the desired temperature, moisture eliminator 25 and damper assemblies 30 and 34. Wall 31 of sump 22 extends a distance above the floor of enclosure 10 in order to provide an adequate quantity of water in sump 22. Also shown is baffle plate 17 which may be included, if desired, for the purpose of reducing eddy currents and improving uniformity of the air flow through the water spray section and moisture eliminator. Conditioned air leaving enclosure 10 enters supply air duct 38 for routing to conditioned zones 40, 46 and 52. Temperature controllers 41, 47 and 39 and associated temperature sensors are connected respectively to damper actuators 42, 48 and 54 for modulating the positions of dampers 43, 49 and 53. Damper actuators 42, 48 and 54 may, if desired, be pneumatically operated actuators when used with suitable transducers. Temperature controllers 41 and 47 are also connected to reheat coil control valves 44 and 50, respectively, for the purpose of heating the conditioned air by reheat coils 45 and 51. Zone 52 represents an interior zone which does not require a reheat coil under normal operating conditions. Return air from the conditioned zones is then routed to mixing chamber 11 via return air damper 57 where it is combined with outside air which enters mixing chamber 11 through outside air damper 24. The volume of outside air admitted is coordinated with a similar volume of return air expelled from the system through exhaust damper 60.

Located near the junction of enclosure 10 and supply air duct 38 is humidity sensing device 26 and associated dew point controller 27. Dew point controller 27 is connected to transducers 21, 55 and 58 which convert the electrical signals to pneumatic signals for operation of the respective damper actuators 23, 56 and 59 thereby controlling the flow of return air and outside air into mixing chamber 11. In addition, dew point controller 27 is connected to control valves 36 and 37 for regulating the flow of heating and cooling media, respectively, so that the spray water temperature may be adjusted as needed for maintaining the desired humidity and temperature levels in the air entering supply air duct 38. Under normal operating conditions the air entering supply air duct 38 is substantially saturated (i.e., at least 95 percent and preferably at least 97 percent) with water vapor.

The volume of air being moved through the system is controlled by varying the pitch of the blades on fan 12. Fan blade positioner 13 regulates the pitch of the blades in response to a pneumatic signal from pressure controller 63. Controller 63 receives signals from pressure sensor 62 located in supply air duct 38 and pressure sensor 64 in conditioned zone 46 in order to generate a differential pressure signal. Sensor 64 may also be located in one of the other conditioned zones since the pressure prevailing in the various zones will normally be comparable. Fan blade positioner 13 is also provided with a source of high pressure air (e.g., 80 pounds per square inch) for operation of the pitch-adjusting mechanism on the fan blade. In addition to controlling fan blade positioner 13, pressure controller 63 also transmits a pneumatic signal to transducer 66 which converts the pneumatic signal to an electrical signal which regulates the output of spray pumps 15 and 19 by means of variable speed drives 14 and 18, respectively. By controlling both the fan capacity and the spray pump capacity from the same signal transmitted by pressure controller 63, a substantially constant air volume to spray water ratio is maintained. The control of spray pumps 15 and 19 is preferably arranged so that only one of the pumps is in operation during periods of low demand for spray water. The signal from controller 63 is also used to activate damper assemblies 30 and 34 via the respective damper assembly actuators 29 and 33 and associated pressure switches 28 and 32. Pressure switches 28 and 32 are preferably adjusted to open and close at different signal levels so that damper assemblies 30 and 34 will open or close at different levels of air volume moving through the system. For example, as the fan capacity is reduced to 75 percent of maximum capacity, normally open damper assembly 30 is moved to the closed position and as fan capacity is further reduced to 50 percent of maximum, damper assembly 34 is also moved to the closed position in order to maintain air velocity through eliminator 25 within its recommended operating range.

Figure 2:
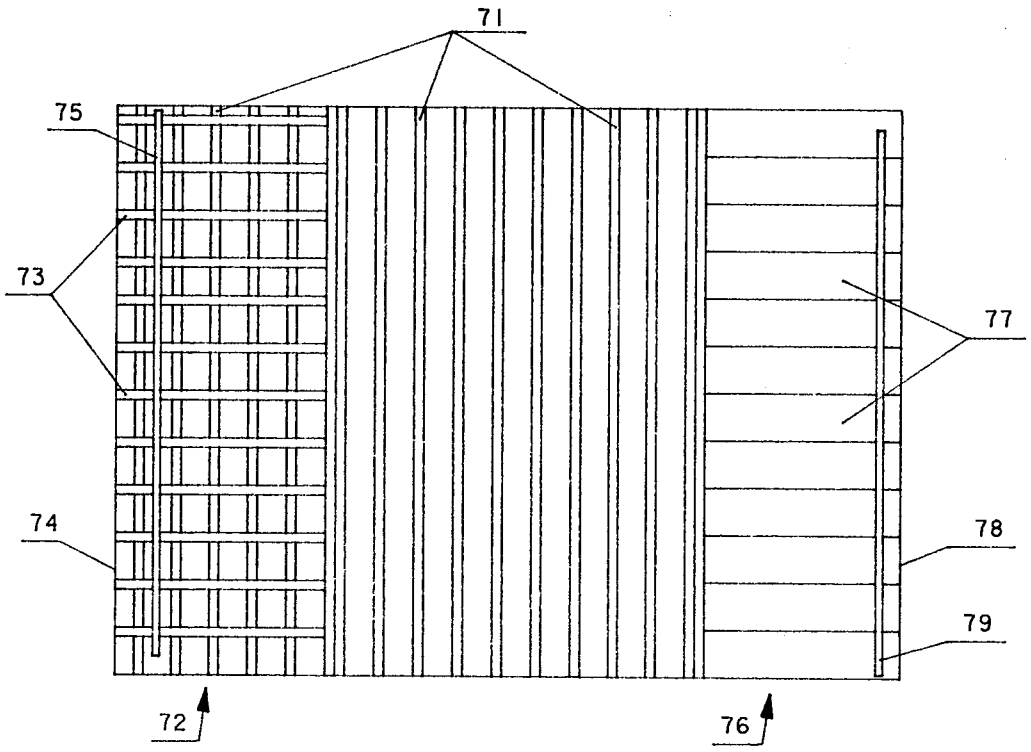
FIG. 2 is an elevation view of a moisture eliminator modified in accordance with the present invention.

FIG. 2 shows an elevation view of a moisture eliminator modified in accordance with the present invention. The vertically disposed eliminator blades 71 are uniformly spaced across the width of the eliminator in parallel relationship. Damper assembly 72 is shown in the open position with a plurality of horizontal damper blades 73 rotatably secured to frame 74 and operated as a unit by connecting rod 75 in a manner well known in the art. Damper assembly 76 is shown in the closed position with damper blades 77 rotatably secured to frame 78 and operated as a unit by connecting rod 79. Actuators (not shown) are connected to rods 75 and 79 for moving the damper blades into the open or closed position in response to an appropriate signal. In the embodiment shown in FIG. 2 each damper assembly covers approximately 25 percent of the face area of the moisture eliminator.

Figure 3:
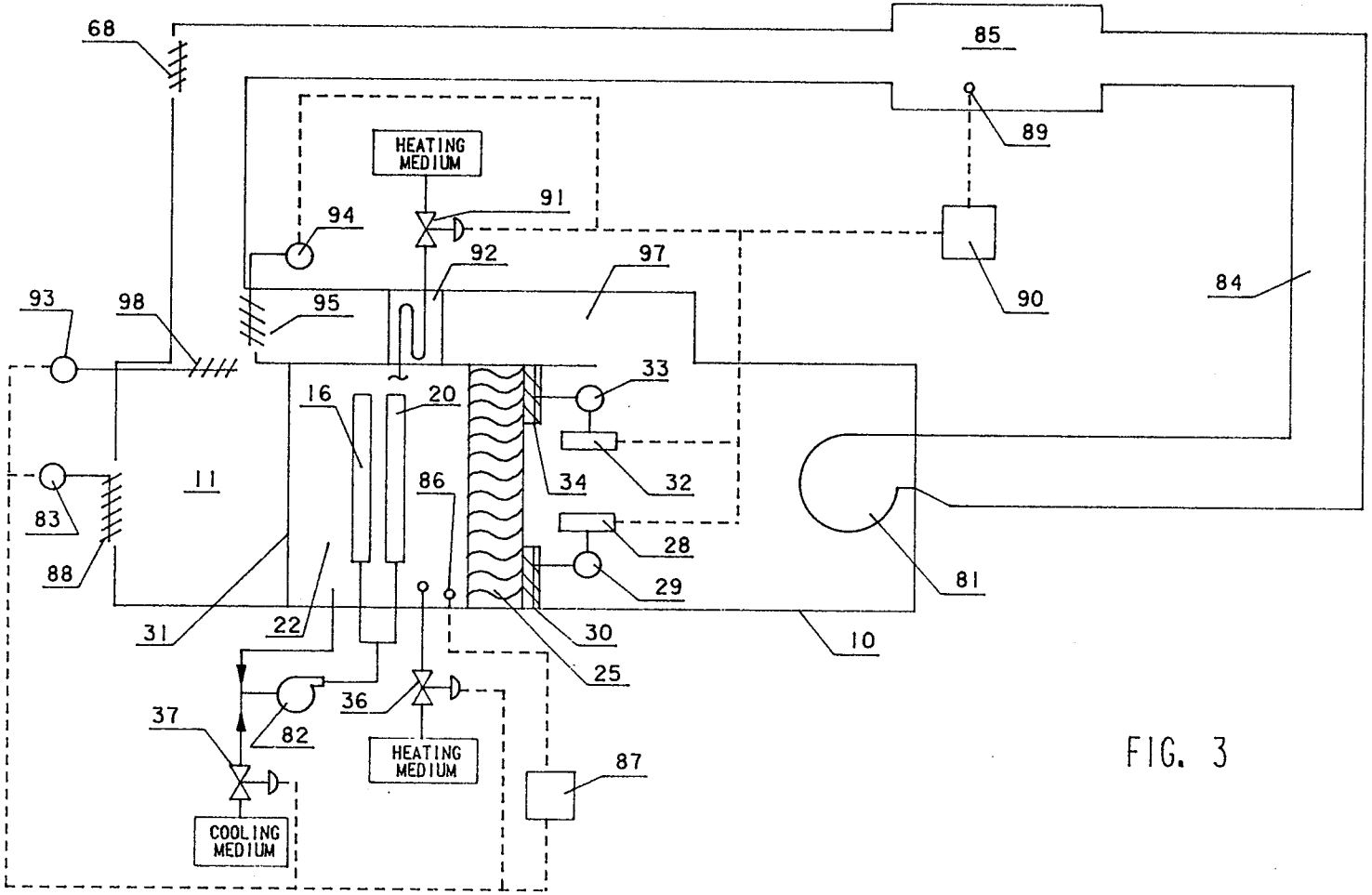
FIG. 3 shows a schematic diagram of an air conditioning system employing a bypass arrangement and a moisture eliminator modified in accordance with the present invention.

The air washer arrangement shown in FIG. 3 includes a bypass for diverting a controlled volume of return air from the conditioned space around the water spray section of the air washer. A substantially constant volume of conditioned air is supplied to conditioned space 85 by fan 81 and duct 84. Wall 31 of spray water sump 22 extends a distance above the floor of enclosure 10 in order to provide a sufficient quantity of water in sump 22. This quantity of water is maintained at a substantially constant temperature (i.e., the desired dew point temperature) by sensor 86 and associated temperature controller 87 which regulates control valves 36 and 37 and the flow of heating and cooling media, respectively, into the spray water system. Controller 87 is also connected to damper actuators 83 and 93 for controlling the flow of return air and outside air through dampers 88 and 98, respectively. Gravity damper 68 is provided for discharging a portion of the return air to the atmosphere to compensate for outside air entering the air washer through damper 88. The return air and outside air are combined in mixing chamber 11 and saturated with water supplied by spray pump 82 to spray heads 16 and 20. The water-saturated air then moves through eliminator 25 where entrained water droplets are removed before the air enters the exit end of enclosure 10. A portion of the return air withdrawn from conditioned space 85 is routed through bypass damper 95 and bypass duct 97 into the exit end of enclosure 10 which serves as the suction plenum for fan 81. The volume of return air routed through bypass damper 95 is regulated by temperature controller 90 and associated temperature sensor 89 located in conditioned space 85. A decrease in dry bulb temperature as detected by sensor 89 causes temperature controller 90 to modulate bypass damper 95 to a more open position via damper actuator 94. Temperature controller 90 also modulates control valve 91 to a more open position when the conditioned space temperature falls so that an increase in heating medium to reheat coil 92 can be effected with a resultant increase in the temperature of the air stream moving through bypass duct 97. The heated air stream from bypass duct 97 is then mixed with the water-saturated and cooled air stream emerging from eliminator 25 in the exit end of enclosure 10. The resulting air mixture constitutes the supply air that is pulled into the suction side of fan 81 for conveyance to the conditioned zone.

As temperature controller 90 modulates bypass damper 95 from a fully closed to a fully open position, the proportion of the system's total air volume moving through bypass duct 97 per unit of time increases and the air volume passing through eliminator 25 correspondingly decreases. Since a decrease in air volume per unit of time through the eliminator results in a corresponding decrease in air velocity, controller 90 is provided with means for transmitting appropriate signals to activate damper assemblies 30 and 34. The respective damper assembly actuators 29 and 33 and associated actuator switches 28 and 32 are designed to close or open the damper assemblies at predetermined operating conditions. Each of damper assemblies 30 and 34 are capable of reducing the effective face area of the eliminator by 25 percent. As temperature controller 90 modulates bypass damper 95 to a position that permits more than 25 percent of the total air volume to pass though bypass duct 97, actuator switch 28 causes actuator 29 to close damper assembly 30 thereby resulting in an increase in air velocity through the unobstructed portion of eliminator 25. Similarly, a further increase in air volume passing through bypass duct 97 to levels of 50 percent or more of the total air volume causes actuator switch 32 to be activated with the resultant closing of damper assembly 34 and an increase in air velocity through the unobstructed central section of eliminator 25. The modulation of bypass damper 95 to a closed position in response to signals from temperature controller 90 causes the foregoing sequence of operation to be reversed. The set points at which damper assemblies 30 and 34 are programmed to open or close may be adjusted to any levels desired so long as the resultant velocity of air moving through the eliminator remains within the recommended operating range for the eliminator.

In both FIGS. 1 and 3 it is understood that those devices capable of transmitting or responding to electrical signals are provided with appropriate sources of energy to operate the devices.

It is apparent that the percentage of the eliminator face area that is provided with air-obstructing means will determine the lowest air volumes that can be accommodated without falling below the minimum air velocity recommended for a given moisture eliminator. Through the use of the present invention it is possible to achieve satisfactory operation of the air washer at fan capacities varying over a wide range of conditions that should satisfy all air conditioning requirements that might be encountered. It is also apparent that a number of variations can be made in the embodiments of the invention disclosed herein without departing from the spirit and scope of the appended claims.

What is claimed is:

1. An air washer for treating an air stream moving through the air washer which comprises:

(a) spray means for injecting controlled amounts of water into the moving air stream, (b) a moisture eliminator downstream of said spray means for removing water droplets entrained in the moving air stream, said moisture eliminator having a maximum effective face area through which the moving air stream passes, (c) means for controlling the volume of air moving through the air washer per unit of time and (d) an air obstructing device positioned adjacent to said moisture eliminator for changing the effective face area of said moisture eliminator in response to changes in the volume of air moving through the air washer per unit of time, said air obstructing device being provided with means responsive to a control signal for moving said device into an air obstructing position for reducing said effective face area when the volume of air moving through the air washer per unit of time falls to a predetermined level and for moving said device into a non-obstructing position for increasing the effective face area when the volume of air moving through the air washer per unit of time rises to a predetermined level.

2. The air washer of claim 1 wherein the means for controlling the volume of air moving through the air washer per unit of time comprises damper means and associated control devices which divert a portion of said moving air stream through bypass conduit means separate from said air washer.

3. The air washer of claim 1 wherein the means for controlling the volume of air moving through the air washer per unit of time comprises a variable capacity fan.

4. The air washer of claim 2 or 3 wherein said air obstructing device comprises a damper assembly positioned adjacent to said moisture eliminator and actuator means associated with the damper assembly for opening and closing said damper assembly in response to a control signal.

5. The air washer of claim 2 or 3 wherein said air obstructing device comprises a plurality of damper assemblies positioned adjacent to said moisture eliminator and actuator means associated with each damper assembly for opening and closing each damper assembly in response to a control signal.

6. The air washer of claim 5 wherein each damper assembly and actuator means associated therewith is provided with means for opening and closing each damper assembly at different predetermined levels of air volume per unit of time moving through the air washer.

7. An air conditioning system for maintaining a conditioned zone at predetermined temperature and humidity levels comprising in combination (a) an air washer comprising a water spray section, means for supplying water to said water spray section and for collecting excess spray water, and a moisture eliminator adjacent to said water spray section having a maximum effective face area through which a stream of air to be treated by the air washer passes, (b) first damper means for admitting to said air washer for treatment controlled quantities of outside air and air returned from said conditioned zone, (c) second damper means and associated control devices for diverting a portion of the air returned from said conditioned zone through bypass conduit means separate from the air washer and for varying the volume of air moving through the air washer per unit of time and (d) means for changing the effective face area of said moisture eliminator in response to changes in the volume of air moving through the air washer per unit of time.

8. The system of claim 7 wherein said means for changing the effective face area of the moisture eliminator is capable of reducing said effective face area when the volume of air moving through the air washer per unit of time falls to a predetermined level and is capable of increasing the effective face area when the volume of air moving through the air washer per unit of time rises to a predetermined level.

9. The system of claim 8 wherein said means for changing the effective face area of the moisture eliminator comprises a damper assembly positioned adjacent to said moisture eliminator and actuator means associated with the damper assembly for opening and closing said damper assembly in response to a control signal.

10. The system of claim 8 wherein said means for changing the effective face area of the moisture eliminator comprises a plurality of damper assemblies positioned adjacent to said moisture eliminator and actuator means associated with each damper assembly for opening and closing each damper assembly in response to a control signal.

11. The system of claim 10 wherein each damper assembly and actuator means associated therewith is provided with means for opening and closing each damper assembly at different predetermined levels of air volume per unit of time moving through the air washer.

12. A method for treating a stream of air moving through an air washer which comprises (a) varying the flow rate of the air moving through the air washer in response to a demand for conditioned air that is to be supplied to a work space or conditioned zone, (b) injecting into the stream of air moving through the air washer a sufficient amount of water in the form of a spray to produce an air stream that is substantially saturated with water vapor, (c) passing the substantially saturated air stream through a moisture eliminator having a maximum effective face area through which the air stream moves and (d) changing the effective face area of the moisture eliminator in response to changes in the flow rate of the air stream moving through the air washer wherein the effective face area of said moisture eliminator is reduced when the flow rate of the air stream moving through the air washer falls to a predetermined level and is increased when the flow rate of the air stream moving through the air washer rises to a predetermined level and wherein the flow rate of the air moving through the air washer is varied by directing a controlled portion of the air stream through bypass conduit means separate from said air washer.

13. The method of claim 12 or 11 wherein the amount of water injected into the stream of air is correspondingly increased or decreased as the flow rate of the air moving through the air washer is increased or decreased.

14. A method for treating a stream of air moving through an air washer that is provided with a variable capacity fan which comprises (a) varying the flow rate of the air moving through the air washer by adjusting the capacity of said fan in response to a demand for conditioned air that is to be supplied to a work space or conditioned zone, (b) injecting into the stream of air a sufficient amount of water in the form of a spray to produce an air stream that is substantially saturated with water vapor, (c) passing the substantially saturated air stream through a moisture eliminator having a maximum effective face area through which the air stream moves and (d) changing the effective face area of the moisture eliminator in response to changes in the flow rate of the air stream moving through the air washer wherein the effective face area of said moisture eliminator is reduced when the flow rate of the air stream moving through the air washer falls to a predetermined level and is increased when the flow rate of the air stream moving through the air washer rises to a predetermined level.

15. An air conditioning system for maintaining a conditioned zone at predetermined temperature and humidity levels comprising in combination (a) a chamber having an entrance end provided with separate modulated damper means for admitting return air from the conditioned zone and outside air into the chamber and an exit end for delivering conditioned air to a supply air duct which supplies conditioned air to the conditioned zone, (b) spray means positioned within the chamber intermediate the entrance and exit ends for spraying sufficient quantities of water into air moving through the chamber to deliver conditioned air to the supply air duct that is substantially saturated with water vapor and is adjusted to a predetermined temperature, (c) a moisture eliminator positioned within the chamber intermediate the spray means and said exit end for removing droplets of water entrained in the conditioned air, said moisture eliminator having a maximum effective face area through which said conditioned air passes, (d) means for moving variable volumes of air per unit of time through the chamber, (e) sensing means for monitoring the dew point of the conditioned air delivered to the supply air duct and control means associated therewith for modulating the damper means which admit said return air from the conditioned zone and outside air into the chamber, (f) means for sensing the temperature of the air in the conditioned zone and control means associated therewith for regulating the volume of air moving through the chamber per unit of time and (g) means for changing the effective face area of the moisture eliminator in response to changes in the volume of air moving through the chamber per unit of time.

16. The system of claim 15 wherein said chamber is provided with a sump in which a quantity of water is maintained for supplying water to said spray means and in which excess spray water is collected, said sump being provided with means for heating and cooling the quantity of water maintained therein.

17. The system of claim 16 wherein the sensing means for monitoring the dew point of the conditioned air comprises a temperature sensor positioned in the quantity of water maintained in the sump and control means associated with said temperature sensor for regulating the means for heating and cooling the quantity of water in the sump and for modulating the separate damper means which admit return air from the conditioned zone and outside air into the chamber.

18. The system of claim 16 wherein the sensing means for monitoring the dew point of the conditioned air comprises an absolute humidity sensing device adapted to sample continuously the conditioned air delivered to the supply air duct and control means associated with said humidity sensing device for regulating the means for heating and cooling the quantity of water in the sump and for modulating the separate damper means which admit return air from the conditioned zone and outside air into the chamber.

19. The system of claim 15, 16, 17 or 18 wherein the means for moving variable volumes of air per unit of time through said chamber comprises damper means and associated control devices which divert a portion of the moving air through bypass conduit means separate from said chamber.

20. The system of claim 15, 16, 17 or 18 wherein the means for moving variable volumes of air per unit of time through said chamber comprises a variable capacity fan.

21. The system of claim 20 wherein the supply air duct is provided with a plurality of terminuses and modulated supply air damper means associated with each of the terminuses for delivering conditioned air to a plurality of conditioned zones in response to temperatures sensed in the conditioned zones, and said control means for regulating the volume of air moving through the chamber per unit of time comprises (a) a temperature controller for modulating the supply air damper means associated with said plurality of terminuses and (b) a pressure controller associated with pressure sensing means located in the supply air duct.

22. The system of claim 21 wherein said pressure controller associated with said pressure sensing means is provided with means for modulating the capacity of said variable capacity fan, for regulating the quantity of water injected into the air by said spray means as the air moves through said chamber, and for changing the effective face area of said moisture eliminator.

23. The system of claim 22 wherein at least one of said terminuses is provided with heating means, said heating means being disposed within the supply air duct downstream of said supply air damper means.

24. The system of claim 22 wherein said means for changing the effective face area of the moisture eliminator is capable of reducing said effective face area when the volume of air moving through the chamber per unit of time falls to a predetermined level and is capable of increasing the effective face area when the volume of air moving through the chamber per unit of time rises to a predetermined level.

25. A method for conditioning the air being directed to a conditioned zone that is being maintained at predetermined temperature and humidity levels comprising the steps of (a) establishing a controlled flow of air through an air conditioning system that includes an air washer with a water spray section and a moisture eliminator having a maximum effective face area through which conditioned air passes, (b) treating the air with a controlled spray of water as it moves through the air washer to produce conditioned air that is substantially saturated with water vapor, (c) monitoring the dew point of the conditioned air being directed to the conditioned zone, (d) regulating the flow of air returned to the air washer from the conditioned zone and outside air admitted into the air conditioned system in response to the dew point of the conditioned air being directed to the conditioned zone, (e) determining the demand for conditioned air by sensing the temperature of the air in the conditioned zone, (f) varying the flow rate of air moving through the air washer in response to a change in demand for conditioned air in the conditioned zone, (g) changing the effective face area of the moisture eliminator in response to variations in the flow rate of air moving through said air washer and moisture eliminator to maintain the air velocity of the air moving through the moisture eliminator within a predetermined range.

26. The method of claim 25 wherein the effective face area of said moisture eliminator is reduced when the flow rate of the air moving through the moisture eliminator falls to a predetermined level and is increased when the flow rate of the air moving through the moisture eliminator rises to a predetermined level.

* * * * *

UNITED STATES PATENT AND TRADEMARK OFFICE

CERTIFICATE OF CORRECTION

PATENT NO. : 4,730,772

DATED : March 15, 1988

INVENTOR(S) : Richard P. Lortie et al.

It is certified that error appears in the above-identified patent and that said Letters Patent is hereby corrected as shown below:

Column 11, line 25, "13" should read --14--.

Column 11, line 25, "12 or 11" should read --12 or 13--.

Column 11, line 30, "14" should read --13--.

Signed and Sealed this

Nineteenth Day of July, 1988

*Attest:*

DONALD J. QUIGG

*Attesting Officer*

*Commissioner of Patents and Trademarks*